US006802952B2

(12) United States Patent
Hsu

(10) Patent No.: US 6,802,952 B2
(45) Date of Patent: Oct. 12, 2004

(54) METHOD FOR SURFACE TREATMENT OF METAL BASE

(75) Inventor: Che-Yuan Hsu, Tu-Chen (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 181 days.

(21) Appl. No.: 10/118,137

(22) Filed: Apr. 5, 2002

(65) Prior Publication Data

US 2003/0089616 A1 May 15, 2003

(30) Foreign Application Priority Data

Nov. 15, 2001 (TW) ..... 90128268 A

(51) Int. Cl.[7] ..... C25D 5/02; C25D 5/48
(52) U.S. Cl. ..... 205/121; 205/135; 205/221
(58) Field of Search ..... 205/171, 120, 205/210, 221, 223, 333, 121, 136, 135

(56) References Cited

U.S. PATENT DOCUMENTS 5,194,136 A * 3/1993 Jeung et al. ..... 205/122
6,147,302 A * 11/2000 Matsuo et al. ..... 174/35 R

FOREIGN PATENT DOCUMENTS

JP 56163299 A * 12/1981 ..... C25D/11/04

OTHER PUBLICATIONS

Abstract only.*

* cited by examiner

*Primary Examiner*—Edna Wong
(74) *Attorney, Agent, or Firm*—Wei Te Chung

(57) ABSTRACT

A method for surface treatment of a metal base includes the steps of: (a) anodizing the base to obtain a first layer of oxidation film on a surface of the base; (b) removing or covering a first area of the oxidation film; and (c) anodizing the base to obtain a second layer of oxidation film. A second area of the oxidation film is thus formed on the base which is different from the first area of the oxidation film. The second area is either higher or lower than the first area, therefore an anaglyphic decorative effect is obtained on the surface of the base.

8 Claims, No Drawings

METHOD FOR SURFACE TREATMENT OF METAL BASE

BACKGROUND OF THE INVENTION

1. Field of the Invention

The present invention relates to a method for surface treatment of a metal base, and particularly to a method which involves at least two anodizing treatments of a metal base to give a surface of the metal base an anaglyphic decorative effect.

2. Related Art

Metals such as aluminum and titanium are becoming more widely used for producing cover structures of electronic devices such as laptop computers, personal digital assistants and mobile phones. Different methods for surface treatment of the metals have been developed to enhance the visual effect of the cover structures. A method for preparing decorative lacquered titanium-based articles is disclosed in U.S. Pat. No. 5,215,605. The method comprises numerous steps including: (a) heating a base of titanium to between 900° C. and 1300° C. in vacuum to grow crystal grains on a surface of the base; and (b) etching the surface of the base with an etchant.

Conventional methods, such as the method described above, for obtaining an anaglyphic decorative effect on a metal article are laborious and costly.

An improved method for surface treatment of a metal article which can overcome the above-mentioned problems is desired.

SUMMARY OF THE INVENTION

An object of the present invention is to provide a simple method for surface treatment of a metal base to give the surface an anaglyphic decorative effect.

Another object of the present invention is to provide a metal base having an anaglyphic decorative effect.

To achieve the above-mentioned objects, a method for surface treatment of a metal base in accordance with the present invention comprises the steps of: (a) anodizing the base to obtain a first layer of oxidation film on a surface of the base; (b) removing or covering a first area of the oxidation film; and (c) anodizing the base to obtain a second layer of oxidation film. A second area of the oxidation film is thus formed on the base which is different from the first area of the oxidation film. The second area is either higher or lower than the first area, therefore an anaglyphic decorative effect is obtained on the surface of the base.

Other objects, advantages and novel features of the present invention will be drawn from the following detailed description of preferred embodiments of the present invention.

DETAILED DESCRIPTION OF THE INVENTION

A method for surface treatment of a metal base for use as an enclosure of a consumer electronic product, comprises the steps of: (a) anodizing the base to obtain a first layer of oxidation film on a surface of the base; (b) removing or covering a first area of the oxidation film; and (c) anodizing the base to obtain a second layer of oxidation film. A second area of the oxidation film is thus formed on the base which is different from the first area of the oxidation film. The second area is either higher or lower than the first area, therefore an anaglyphic decorative effect is obtained on the surface of the base. If required, steps (b) and (c) can be repeated to enhance the anaglyphic effect of the treated surface.

The foregoing method is suitable for surface treatment of aluminum, aluminum alloy, titanium, titanium alloy and other metals which are suitable for anodizing treatment.

The following examples illustrate selected detailed embodiments to practice the method of the present invention:

EXAMPLE 1

(1) An aluminum alloy base is treated with an alkaline aqueous solution containing sodium hydroxide (NaOH) to clean a surface of the base.

(2) An anodizing solution comprising essentially water and 0.6% phosphoric acid ($H_3PO_4$) by weight is provided. The base and a cathode are immersed in the solution; Electrical power having a potential of 50 volts is applied between the base and the cathode. The power has a current density within the range of 10 to 50 milliamperes per square centimeter ($mA/cm^2$). This anodizing treatment is continued for about 20 minutes at room temperature. A first layer of oxidation film is thus formed on the surface of the base.

(3) A first area of the first layer is removed by laser etching according to a predetermined pattern. A remaining second area of the first layer stays intact.

(4) Finally, the base is anodized again by essentially repeating step (2). This treatment is performed under a different operating condition to obtain a different thickness of oxidation film. Thus, a second layer of oxidation film is formed on the surface of the base. Since the first area corresponding to the predetermined pattern is lower than the second area, an anaglyphic decorative effect is obtained on the surface of the base.

EXAMPLE 2

(1) An aluminum alloy base is treated with an alkaline aqueous solution containing sodium carbonate ($Na_2CO_3$) to clean a surface of the base.

(2) An anodizing solution comprising essentially water and 0.8% sulphuric acid ($H_2SO_4$) by weight is provided. The base and a cathode are immersed in the solution. Electrical power having a potential of 40 volts is applied between the base and the cathode. The power has a current density within the range of 10 to 50 $mA/cm^2$. This anodizing treatment is continued for about 20 minutes at room temperature. A first layer of oxidation film is thus formed on the surface of the base.

(3) A first area of the first layer not to be etched according to a predetermined pattern is covered with protective ink by way of screen-printing.

(4) The aluminum alloy base is treated with $H_3PO_4$ solution. A second area of the first layer not covered with the ink is etchingly removed by the solution according to the predetermined pattern.

(5) The base is treated with an alkaline aqueous solution to remove the ink from the first area of the surface.

(6) Finally, the base is anodized again by essentially repeating step (2). This treatment is performed under a different operating condition to obtain a different thickness of oxidation film. A second layer of oxidation film is formed on the base. Since the first area corresponding to the predetermined pattern is higher than the second area, an anaglyphic decorative effect is obtained on the surface of the base.

EXAMPLE 3

(1) An aluminum alloy base is treated with an alkaline aqueous solution to clean a surface of the base.

(2) A first area of the surface is covered with protective ink according to a predetermined pattern by way of screen-printing.

(3) An anodizing solution comprising essentially water and 0.5% $H_2SO_4$ by weight is provided. The base and a cathode are immersed in the solution. Electrical power having a potential of 40 volts is applied between the base and the cathode. The power has a current density within the range of 10 to 50 mA/cm$^2$. This anodizing treatment is continued for about 20 minutes at room temperature. Thus, a first layer of oxidation film is formed on a second area of the surface not covered with the ink.

(4) The base is treated with an alkaline aqueous solution to remove the ink from the first area of the surface.

(5) An anodizing solution comprising essentially water and 0.6% $H_3PO_4$ by weight is provided. The base and a cathode are immersed in the solution. Electrical power having a potential of 40 volts is applied between the base and the cathode. The power has a current density within the range of 10 to 50 mA/cm$^2$. This anodizing treatment is continued for about 10 minutes at room temperature. A second layer of oxidation film is formed on the base. Since the second area corresponding to the predetermined pattern is higher than the first area, an anaglyphic decorative effect is obtained on the surface of the base.

It is believed that the present invention and its advantages will be understood from the foregoing description and it will be apparent that various changes may be made thereto without departing from the spirit and scope of the invention or sacrificing all of its material advantages, the examples hereinbefore described merely being preferred or exemplary embodiments of the invention.

I claim:

1. A method for surface treatment of a metal base, comprising the steps of:

(a) covering a part of the base with protective ink according to a predetermined pattern;

(b) anodizing the base to obtain a first layer of oxidation film on a surface of the base;

(c) removing the protective ink; and (d) anodizing the base again to form a second layer of oxidation film on the base corresponding to the predetermined pattern;

whereby an anaglyphic decorative effect is obtained on the base.

2. The method of claim 1, wherein the second anodizing step (d) is performed under an operating condition that is different from an operating condition of the first anodizing step (b).

3. The method of claim 1, wherein the second anodizing step (d) is preformed for approximately 10 minutes at room temperature.

4. The method of claim 1, wherein the base is treated with an alkaline aqueous solution to clean the base before step (a).

5. The method of claim 1, wherein electrical power applied for the first anodizing step (b) is in the range of 10 to 50 volts.

6. The method of claim 5, wherein the electrical power has a current density in the range of 10 to 50 milliamperes per square centimeter.

7. A method for surface treatment of a metal base, comprising the steps of:

(a) cleaning a surface of the base;

(b) anodizing the base to obtain a first layer of oxidation film on the surface of the base;

(c) covering areas not to be etched with a protective ink according to a predetermined pattern;

(d) etchingly removing areas of the first layer not covered with the protective ink by using phosphoric acid;

(e) removing the protective ink by using an alkaline aqueous solution; and (f) repeating step (b) to obtain a second layer of oxidation film.

8. The method of claim 7, further including the steps of repeating steps (c) to (e) for etching the second layer.

* * * * *